US005979989A

United States Patent [19]

Herbst

[11] Patent Number: 5,979,989

[45] Date of Patent: Nov. 9, 1999

[54] UNIVERSAL HEALTH SEAT

[75] Inventor: Erik Rijk AndréHerbst, Zwolle, Netherlands

[73] Assignee: Erik Herbst International B.V., Fort, Netherlands

[21] Appl. No.: 09/231,445

[22] Filed: Jan. 14, 1999

Related U.S. Application Data

[63] Continuation of application No. PCT/NL97/00423, Jul. 16, 1997.

[30] Foreign Application Priority Data

Jul. 18, 1996 [NL] Netherlands ..... 1003633

[51] Int. Cl.[6] ..... A47C 7/02

[52] U.S. Cl. ..... 297/452.22; 297/452.21; 297/452.23

[58] Field of Search ..... 297/452.21, 452.22, 297/452.23, 452.24

[56] References Cited

U.S. PATENT DOCUMENTS

| | | | |
|---|---|---|---|
| 669,112 | 3/1901 | Braasch | 297/452.23 |
| 2,071,988 | 2/1937 | Sasse | 297/452.22 |
| 2,825,393 | 3/1958 | Warburton et al. | 297/452.22 X |

FOREIGN PATENT DOCUMENTS

| | | | |
|---|---|---|---|
| 1 497 221 | 10/1967 | France . | |
| 2226957 | 11/1974 | France . | |
| 872831 | 4/1953 | Germany | 297/452.24 |
| 1115421 | 10/1961 | Germany | 297/452.21 |
| 342 428 | 2/1931 | United Kingdom . | |
| 1 426 540 | 4/1973 | United Kingdom . | |

*Primary Examiner*—Laurie K. Cranmer
*Attorney, Agent, or Firm*—Hoffmann & Baron, LLP

[57] ABSTRACT

Universal health seat in which the peripheral edge of the top face of the sitting part 5 and the sitting face 4 are formed in such a way that the user thereof receives ideal support. The pelvis of the user is tilted into a correct position by a combination of the position of the recess 6 and the support of the thighs by the peripheral edge of the top face of the sitting part 5. The position of the pelvis affects the curvatures of the spine and consequently the sitting posture of the user. Back complaints are prevented in this way by the universal health seat.

4 Claims, 2 Drawing Sheets

UNIVERSAL HEALTH SEAT

CROSS REFERENCE TO RELATED APPLICATIONS

This is a continuing application of PCT/NL97/00423 filed Jul. 16, 1997,

FIELD OF THE INVENTION

The invention relates to a universal health seat, comprising a sitting part supported by one or more legs and having a peripheral edge and a substantially flat top face in which a recess with an axis extending at right angles to the top face is provided, in which each point on the peripheral edge can be described by the distance between the point and the axis, which distance is a function of an angle between a reference line situated in the top face and extending through the axis, and a connecting line extending through the point and the axis.

BACKGROUND OF THE INVENTION

Such a seat is generally known. The peripheral edge of the sitting part in such a seat is generally symmetrical, for example rectangular or U-shaped, and the recess is provided in the centre thereof. GB-A-342.428 discloses a seat having a rectangular peripheral edge and a substantially flat top face comprising two recessed portions. The depressions enable a user of the seat to avoid discomfort arising from pressure upon the pelvis bones. For a good sitting posture, it is important that the pelvis of a person seated on the seat tilts towards a certain position. For the tilting of the pelvis has an effect on the curvatures of the spine of the user. A wrong posture can therefore lead to many back complaints. The tilting of the pelvis is affected to a large extent by the degree of support of the thighs combined with the position of the recess.

A disadvantage in the case of this known seat is that it is intended for sitting on in one position which is determined by the designer. This means that in the case of any person sitting on it only one specific degree of support of the thighs combined with the position of the recess is possible. This support will hardly ever be the most ideal, because no two persons are the same. Each person in fact has a build, posture, weight and height which is characteristic of him/her. For example, the length ratio between thighs and lower legs and between lumbar region of the spine, thoracic region of the spine and cervical region of the spine, and the distance between the seat bones, is different in every case. In the case of each person there should therefore be a characteristic support of the thighs combined with a suitable support of the seat bones, i.e. the buttocks, in the recess.

SUMMARY OF THE INVENTION

The object of the present invention is to provide a universal health seat in which this disadvantage is overcome.

This object is achieved according to the invention by the fact that the distance as a function of the angle $\alpha$ for $0° < \alpha \leqq$ approx. 30° describes substantially a straight line, for $30° < \alpha \leqq$ approx. 330° describes an irregular, wavy line with several minimum and maximum values, and for $330° < \alpha \leqq 360°$ again describes substantially a straight line, the above in such a way that for any person seated thereon the seat has at least one position relative to the reference line in which the support of the thighs, combined with the recess in the sitting part, is such that the pelvis of the seated person tilts towards a position in which the spine is forced into ergonomically the most ideal position.

In this way the undersides of the thighs of the user are supported more or less depending on the angle at which the user is sitting relative to the reference line. If the user is sitting on the seat at the correct angle relative to the reference line, the pelvis tilts to the correct position, and the spine ultimately goes automatically into the ideal position, and the user can sit completely relaxed on the seat according to the invention. The seat thus has an infinite number of possible sitting positions, accompanied by as many different supporting positions of the thighs, combined with the recess. Virtually any person seated thereon can therefore assume a position on the seat which is the most ideal for him/her.

Further preferred embodiments of a seat according to the invention are described in claims 2–4.

BRIEF DESCRIPTION OF THE DRAWINGS

A preferred embodiment of a seat according to the invention will be described below with reference to the appended drawing, in which.

DESCRIPTION OF THE PREFERRED EMBODIMENT

Figure 1:
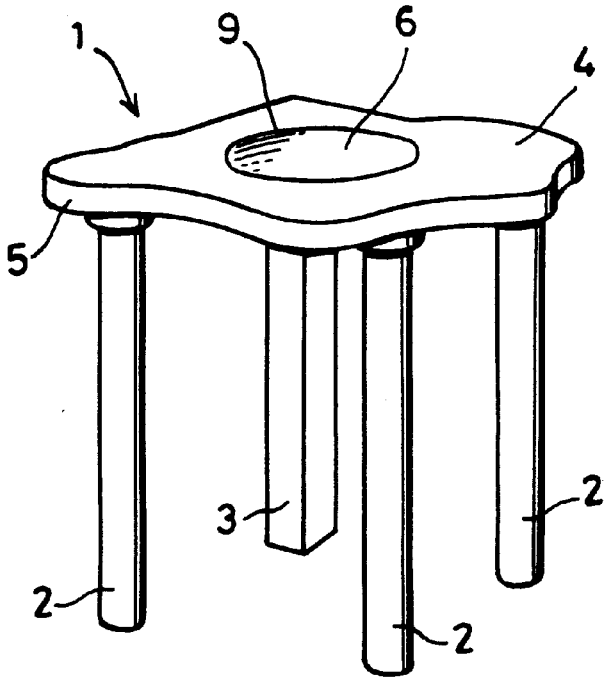
FIG. 1 is a perspective view of a universal health seat according to the invention.

FIG. 1 illustrates a universal health seat 1 according to the invention. The seat 1 comprises three round legs 2 and one substantially square leg 3. The seat 1 also has a sitting face 4, formed by the top face of a sitting part 5.

The legs 2, 3 support the sitting part 5 in such a way that, irrespective of the position of the user, the seat 1 is stable on flat ground. The distance between the sitting face 4 and the ground lies substantially between 450–480 mm, and in the preferred embodiment of the seat 1 is equal to approx. 455 mm. The seat 1 according to the preferred embodiment is suitable for persons of 1.65 m to 1.95 m. If the user of the seat is taller than 1.95 m, the legs 2, 3 must be so much longer that the distance from the sitting face to the ground on which the seat is standing is equal to approx. 475 mm.

A recess 6 in the sitting part 5 can also be seen in FIG. 1. The transition from the recess 6 to the sitting face 4 is a circular transition 9. The shape of the recess interacts with the shape of the sitting part 5, in order to bring the spine of the user of the seat into the correct position.

Figure 2:
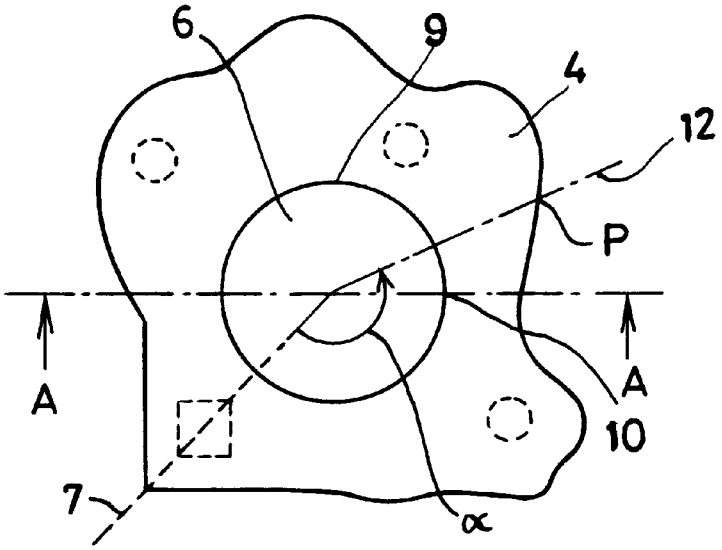
FIG. 2 is a top view of a seat according to the invention.

FIG. 2 illustrates the shape of the peripheral edge of the sitting part 5 and the circular transition 9 from the recess 6 to the sitting face 4.

The shape of the peripheral edge of the sitting part 5 is determined depending on an angle $\alpha$ between a reference line 7 extending through the axis of the recess 6 and a connecting line 12 extending through a point P on the peripheral edge and the axis. The angle $\alpha$ is positive anticlockwise. At a certain angle $\alpha$ there is a prescribed distance from the point P on the connecting line 12 to the axis of the recess 6. The collection of points formed in this way, as shown in Table I, determines the irregular, wavy shape of the peripheral edge of the sitting face 4.

From the reference line 7 up to an angle $\alpha$ of approx. 30° anticlockwise the distance from a point P on the peripheral edge to the axis of the recess 6 describes substantially a straight line. Between $\alpha$=350° and $\alpha$=500° the distance reaches a minimum value lying between 165 and 175 mm. With further increasing $\alpha$ the distance shows a wavy curve with minima at the values of $\alpha$ between 120° and 135°, 195° and 210 °, 245° and 260° and between 315° and 330°, with the distances between 160 and 170 mm, 185 and 195 mm, 210 and 220 mm and between 165 and 175 mm respectively. Thereafter, the distance again describes a substantially straight line until $\alpha$ is 360°, and the peripheral edge is closed.

The maxima are at $\alpha$=0° (=360°) with the distance approx. 238 mm, and at the values of $\alpha$ between 95° and 110°, 170° and 185°, 225° and 240° and between 270° and 285°, where the distances lie between 250 and 260 mm, 220 and 230 mm, 230 and 240 mm and between 240 and 250 mm respectively.

Figure 3:
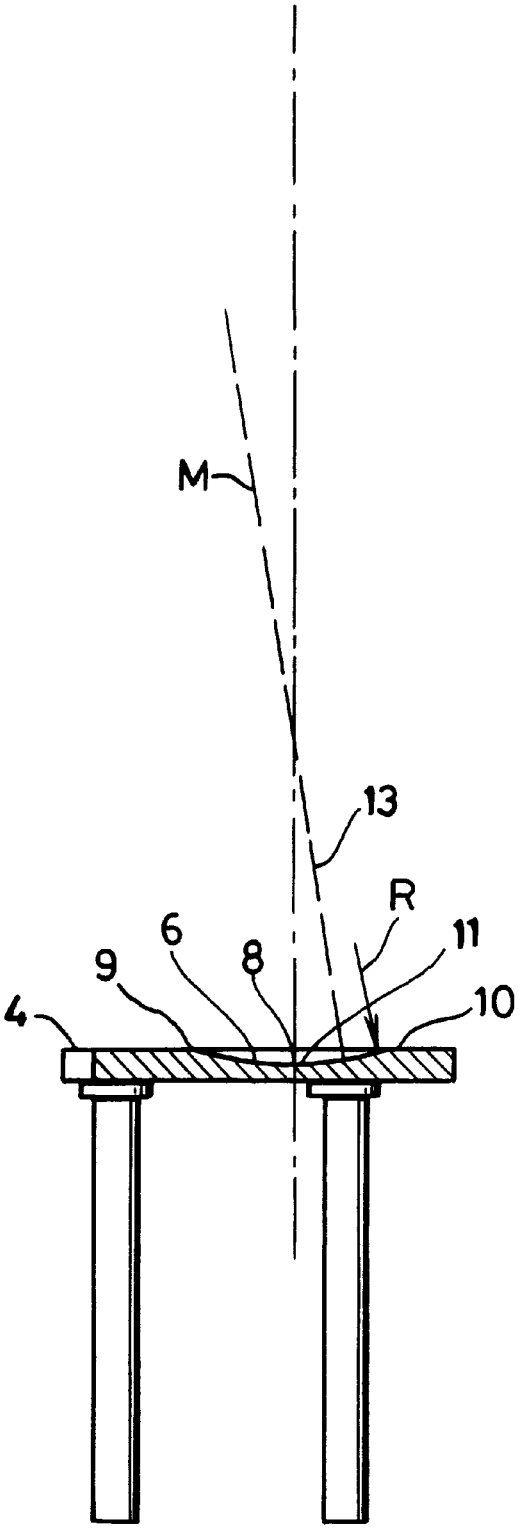
FIG. 3 is a view in section of a seat according to the invention along line A—A in FIG. 2.

In order to illustrate the shape of the recess 6, FIG. 3 shows a cross-section along line A—A in FIG. 2. The recess 6 has a deepest point 8 situated on the axis of the recess 6. The deepest point 8 lies approx. 13 mm lower than the sitting face 4 of the seat 1. The transition 9 from the recess 6 to the sitting face 4 is a circle with a radius of approx. 100 mm. The recess 6 has a continuous surface which can be described by circular arc segments extending downwards from the transition 9. The circular arc segments in the embodiment shown converge in the deepest point 8. The centre point M of a describing circular arc segment lies on a perpendicular bisector of a line part connecting the deepest point 8 and the point 10 at the transition 9. The perpendicular bisector also lies in a plane through the describing circular arc segment and the axis of the recess 6.

The centre points M of all describing circular arc segments lie on a conical face formed by all perpendicular bisectors together. The line connecting all perpendicular bisectors to each other (not shown) forms a closed, continuous curve on the conical face.

The radius R of the describing circular arc segments is determined for eight positions. Each position corresponds to an angle $\alpha$ which is a multiple of 45°.

Table II gives the radius R depending on the angle $\alpha$.

At the position of the deepest point 8, a spherical protuberance 11 is preferably provided in the recess 6, said protuberance having a diameter of approx. 15 mm and a height of approx. 1 mm.

The seat 1 according to the invention is preferably made of unvarnished and unsteamed beechwood, in particular without metal parts. Beechwood is advantageous because it can very quickly assume the body temperature of the user. Moreover, not varnishing the wood means that it can continue to breathe, and the user has a certain grip, so that he/she will not easily slide off. Finally, not using any metal parts means that no electromagnetic fields are brought close to the user's body.

A very advantageous embodiment of a universal health seat according to the invention is thus described, in which the specific shape of the peripheral edge, combined with the specific shape of the recess, for any person seated thereon has at least one position in which the spine is put under as little strain as possible. Sitting at another point on the seat gives a different degree of support for the thighs, consequently a change in the angle of the hips, and therefore a change in the tilt of the pelvis. This tilt changes the curves in the lumbar region of the spine, the thoracic region of the spine and the cervical region of the spine, with the result that the spine moves further forward or backward. Moreover, sitting at another point on the seat produces a different angle for the seat bones, which in fact rest on a different point in the recess, which again results in a change in the tilt of the pelvis etc. The result of all this is a stretching of the entire spine and an automatic correction of the position of the head. This means that the pressure on the nerve paths coming out of the spine is advantageously minimal, and the pressure in the vertebrae and the intervertebral discs is as far as possible axial, i.e. at right angles to the sitting face. In addition, the blood vessels running along or through the vertebrae undergo as little pressure as possible, which results in better blood circulation in the organs and limbs. All in all, a very relaxed sitting posture is possible on the universal health seat according to the invention. This is important in particular in professions where people have to sit frequently and for long periods, and where many back complaints also occur. Each user must find his own ideal position, by shifting a few degrees at a time relative to the reference line, preferably with his/her feet flat upon the ground, until the optimum feeling of relaxation is obtained.

While the invention has been described in preferred forms, those skilled in the art will recognize that many modifications, additions, and deletions can be made therein without departing from the spirit and scope of the invention as defined in the following claims.

TABLE 1

| DE-GREES | DIS-TANCE (mm) | DE-GREES | DISTANCE (mm) | DEGREES | DISTANCE (mm) |
|---|---|---|---|---|---|
| 0 | 238 | 31 | 175 | 62 | 186 |
| 1 | 235 | 32 | 174. | 63 | 186.5 |
| 2 | 232 | 33 | 173 | 64 | 187 |
| 3 | 228 | 34 | 172.5 | 65 | 188 |
| 4 | 224 | 35 | 172 | 66 | 189 |
| 5 | 221 | 36 | 171.5 | 67 | 190 |
| 6 | 218 | 37 | 171 | 68 | 190.5 |
| 7 | 215 | 38 | 171 | 69 | 191.5 |
| 8 | 212 | 39 | 170.5 | 70 | 192 |
| 9 | 209 | 40 | 170 | 71 | 193 |
| 10 | 206 | 41 | 170 | 72 | 194 |
| 11 | 204 | 42 | 170.5 | 73 | 195 |
| 12 | 202 | 43 | 171 | 74 | 196 |
| 13 | 200 | 44 | 171 | 75 | 197.5 |
| 14 | 198 | 45 | 171.5 | 76 | 199 |
| 15 | 196 | 46 | 172 | 77 | 200 |
| 16 | 194 | 47 | 173 | 78 | 203 |
| 17 | 192 | 48 | 174 | 79 | 207 |
| 18 | 190 | 49 | 175 | 80 | 210 |
| 19 | 189 | 50 | 176 | 81 | 214.5 |
| 20 | 187 | 51 | 177 | 82 | 218 |
| 21 | 186 | 52 | 178 | 83 | 224 |
| 22 | 184 | 53 | 178.5 | 84 | 226 |
| 23 | 183 | 54 | 179 | 85 | 230 |
| 24 | 182 | 55 | 180 | 86 | 235 |
| 25 | 181 | 56 | 181 | 87 | 240 |
| 26 | 179 | 57 | 182 | 88 | 243 |
| 27 | 178 | 58 | 183 | 89 | 248 |
| 28 | 177 | 59 | 183.5 | 90 | 250 |
| 29 | 176 | 60 | 184 | 91 | 252 |
| 30 | 175 | 61 | 185 | 92 | 253 |
| 93 | 254 | 123 | 168 | 153 | 188 |
| 94 | 253.5 | 124 | 167 | 154 | 189.5 |
| 95 | 254 | 125 | 166 | 155 | 191.5 |
| 96 | 254 | 126 | 165.5 | 156 | 194 |
| 97 | 254 | 127 | 165 | 157 | 195 |
| 98 | 255 | 128 | 164.5 | 158 | 197 |
| 99 | 256 | 129 | 165 | 159 | 200 |
| 100 | 258 | 130 | 165 | 160 | 202.5 |
| 101 | 258 | 131 | 165 | 161 | 205 |
| 102 | 258 | 132 | 165 | 162 | 206 |
| 103 | 257.5 | 133 | 165.S | 163 | 208 |
| 104 | 255.5 | 134 | 166 | 164 | 210.5 |

TABLE 1-continued

| DE-GREES | DIS-TANCE (mm) | DE-GREES | DISTANCE (mm) | DEGREES | DISTANCE (mm) |
|---|---|---|---|---|---|
| 105 | 252.5 | 135 | 166 | 165 | 214 |
| 106 | 249 | 136 | 166.5 | 166 | 215.5 |
| 107 | 246 | 137 | 167 | 167 | 217 |
| 108 | 243 | 138 | 167.5 | 168 | 219 |
| 109 | 239 | 139 | 168.5 | 169 | 221 |
| 110 | 234 | 140 | 169 | 170 | 223.5 |
| 111 | 226 | 141 | 170 | 171 | 224 |
| 112 | 21.5 | 142 | 171 | 172 | 225 |
| 113 | 200 | 143 | 172 | 173 | 225.5 |
| 114 | 192 | 144 | 173 | 174 | 226.5 |
| 115 | 187 | 145 | 174 | 175 | 227 |
| 116 | 183 | 146 | 176 | 176 | 227.5 |
| 117 | 180 | 147 | 177 | 177 | 227 |
| 118 | 177 | 148 | 178.5 | 178 | 227 |
| 119 | 174 | 149 | 180 | 179 | 227.5 |
| 120 | 173 | 150 | 181 | 180 | 228 |
| 121 | 171 | 151 | 184 | 181 | 228.5 |
| 122 | 169 | 152 | 186 | 182 | 227.5 |
| 183 | 227 | 213 | 197 | 243 | 223.5 |
| 184 | 226.5 | 214 | 199 | 244 | 222.5 |
| 185 | 226 | 215 | 202 | 245 | 221 |
| 186 | 225 | 216 | 205 | 246 | 219 |
| 187 | 223 | 217 | 207 | 247 | 217.5 |
| 188 | 221 | 218 | 210 | 248 | 216 |
| 189 | 218 | 219 | 213 | 249 | 215.5 |
| 190 | 214 | 220 | 217 | 250 | 215 |
| 191 | 209.5 | 221 | 220 | 251 | 215 |
| 192 | 205.5 | 222 | 222 | 252 | 214.5 |
| 193 | 202 | 223 | 224 | 253 | 215 |
| 194 | 199 | 224 | 226 | 254 | 215 |
| 195 | 197 | 225 | 228 | 255 | 215.5 |
| 196 | 195 | 226 | 229 | 256 | 216.5 |
| 197 | 193 | 227 | 230 | 257 | 217 |
| 198 | 192 | 228 | 231 | 258 | 219 |
| 199 | 190.5 | 229 | 231.5 | 259 | 220 |
| 200 | 189.5 | 230 | 233 | 260 | 222 |
| 201 | 189 | 231 | 233 | 261 | 225 |
| 202 | 188.5 | 232 | 234 | 262 | 228.5 |
| 203 | 188 | 233 | 233 | 263 | 232.5 |
| 204 | 188.5 | 234 | 232.5 | 264 | 235 |
| 205 | 188.5 | 235 | 232 | 265 | 236 |
| 206 | 189.5 | 236 | 232 | 266 | 238.5 |
| 207 | 190 | 237 | 231 | 267 | 240 |
| 208 | 190.5 | 238 | 230 | 268 | 241 |
| 209 | 191.5 | 239. | 229 | 269 | 242 |
| 210 | 192 | 240 | 228 | 270 | 243 |
| 211 | 194 | 241 | 226 | 271 | 244 |
| 212 | 196 | 242 | 225 | 272 | 244.5 |
| 273 | 245 | 303 | 208 | 333 | 177 |
| 274 | 245 | 304 | 205 | 334 | 178 |
| 275 | 245 | 305 | 205 | 335 | 179 |
| 276 | 245 | 306 | 203 | 336 | 180 |
| 277 | 244 | 307 | 202 | 337 | 182 |
| 278 | 243.5 | 308 | 200 | 338 | 182.5 |
| 279 | 243 | 309 | 198 | 339 | 184 |
| 280 | 243 | 310 | 196 | 340 | 185.5 |
| 281 | 242 | 311 | 194 | 341 | 187 |
| 282 | 242 | 312 | 192 | 342 | 189 |
| 283 | 241.5 | 313 | 189.5 | 343 | 190.5 |
| 284 | 240 | 314 | 187.5 | 344 | 192.5 |
| 285 | 239 | 315 | 186 | 345 | 195 |
| 286 | 238 | 316 | 183 | 346 | 197 |
| 287 | 236.5 | 317 | 181 | 347 | 198.5 |
| 288 | 235 | 318 | 179 | 348 | 200.5 |
| 289 | 234 | 319 | 177 | 349 | 203.5 |
| 290 | 232 | 320 | 175 | 350 | 205 |
| 291 | 230 | 321 | 173 | 351 | 208.5 |
| 292 | 228 | 322 | 171 | 352 | 211 |
| 293 | 226 | 323 | 170 | 353 | 213 |
| 294 | 225 | 324 | 170 | 354 | 217 |
| 295 | 223.5 | 325 | 171 | 355 | 220 |
| 296 | 222 | 326 | 171.5 | 356 | 224 |
| 297 | 219 | 327 | 172 | 357 | 227 |
| 298 | 218 | 328 | 172.5 | 358 | 230 |
| 299 | 216.5 | 329 | 173.5 | 359 | 234 |

TABLE 1-continued

| DE-GREES | DIS-TANCE (mm) | DE-GREES | DISTANCE (mm) | DEGREES | DISTANCE (mm) |
|---|---|---|---|---|---|
| 300 | 214 | 330 | 174 | | |
| 301 | 212 | 331 | 175 | | |
| 302 | 210 | 332 | 176 | | |

TABLE II

| α (degrees) | RADIUS R (mm) |
|---|---|
| 45 | 1088.02 |
| 90 | 13828.15 |
| 135 | 567.96 |
| 180 | 385.38 |
| 225 | 745.88 |
| 270 | 13828.15 |
| 315 | 567.96 |
| 360 | 2015.29 |

What is claimed is:

1. Universal health seat, comprising a sitting part supported by one or more legs and having a peripheral edge and a substantially flat top face in which a recess with an axis extending at right angles to the top face is provided, in which each point on said peripheral edge can be described by a distance between said point and said axis, which distance is a function of an angle α between a reference line situated in said top face and extending through said axis, and a connecting line extending through said point and said axis, wherein said distance as a function of said angle α for $0° < \alpha \leqq$ approx. 30° describes substantially a straight line, for $30° < \alpha \leqq$ approx. 330° describes an irregular, wavy line with several minimum and maximum values, and for $330° < \alpha \leqq 360°$ again describes substantially a straight line.

2. Universal health seat according to claim 1, wherein said distance as a function of said angle α substantially corresponds to the following values:

| DE-GREES | DIS-TANCE (mm) | DE-GREES | DISTANCE (mm) | DEGREES | DISTANCE (mm) |
|---|---|---|---|---|---|
| 0 | 238 | 31 | 175 | 62 | 186 |
| 1 | 235 | 32 | 174. | 63 | 186.5 |
| 2 | 232 | 33 | 173 | 64 | 187 |
| 3 | 228 | 34 | 172.5 | 65 | 188 |
| 4 | 224 | 35 | 172 | 66 | 189 |
| 5 | 221 | 36 | 171.5 | 67 | 190 |
| 6 | 218 | 37 | 171 | 68 | 190.5 |
| 7 | 215 | 38 | 171 | 69 | 191.5 |
| 8 | 212 | 39 | 170.5 | 70 | 192 |
| 9 | 209 | 40 | 170 | 71 | 193 |
| 10 | 206 | 41 | 170 | 72 | 194 |
| 11 | 204 | 42 | 170.5 | 73 | 195 |
| 12 | 202 | 43 | 171 | 74 | 196 |
| 13 | 200 | 44 | 171 | 75 | 197.5 |
| 14 | 198 | 45 | 171.5 | 76 | 199 |
| 15 | 196 | 46 | 172 | 77 | 200 |
| 16 | 194 | 47 | 173 | 78 | 203 |
| 17 | 192 | 48 | 174 | 79 | 207 |
| 18 | 190 | 49 | 175 | 80 | 210 |
| 19 | 189 | 50 | 176 | 81 | 214.5 |
| 20 | 187 | 51 | 177 | 82 | 218 |
| 21 | 186 | 52 | 178 | 83 | 224 |
| 22 | 184 | 53 | 178.5 | 84 | 226 |
| 23 | 183 | 54 | 179 | 85 | 230 |
| 24 | 182 | 55 | 180 | 86 | 235 |
| 25 | 181 | 56 | 181 | 87 | 240 |

-continued

| DE-GREES | DIS-TANCE (mm) | DE-GREES | DISTANCE (mm) | DEGREES | DISTANCE (mm) |
|---|---|---|---|---|---|
| 26 | 179 | 57 | 182 | 88 | 243 |
| 27 | 178 | 58 | 183 | 89 | 248 |
| 28 | 177 | 59 | 183.5 | 90 | 250 |
| 29 | 176 | 60 | 184 | 91 | 252 |
| 30 | 175 | 61 | 185 | 92 | 253 |
| 93 | 254 | 123 | 168 | 153 | 188 |
| 94 | 253.5 | 124 | 167 | 154 | 189.5 |
| 95 | 254 | 125 | 166 | 155 | 191.5 |
| 96 | 254 | 126 | 165.5 | 156 | 194 |
| 97 | 254 | 127 | 165 | 157 | 195 |
| 98 | 255 | 128 | 164.5 | 158 | 197 |
| 99 | 256 | 129 | 165 | 159 | 200 |
| 100 | 258 | 130 | 165 | 160 | 202.5 |
| 101 | 258 | 131 | 165 | 161 | 205 |
| 102 | 258 | 132 | 165 | 162 | 206 |
| 103 | 257.5 | 133 | 165.S | 163 | 208 |
| 104 | 255.5 | 134 | 166 | 164 | 210.5 |
| 105 | 252.5 | 135 | 166 | 165 | 214 |
| 106 | 249 | 136 | 166.5 | 166 | 215.5 |
| 107 | 246 | 137 | 167 | 167 | 217 |
| 108 | 243 | 138 | 167.5 | 168 | 219 |
| 109 | 239 | 139 | 168.5 | 169 | 221 |
| 110 | 234 | 140 | 169 | 170 | 223.5 |
| 111 | 226 | 141 | 170 | 171 | 224 |
| 112 | 21.5 | 142 | 171 | 172 | 225 |
| 113 | 200 | 143 | 172 | 173 | 225.5 |
| 114 | 192 | 144 | 173 | 174 | 226.5 |
| 115 | 187 | 145 | 174 | 175 | 227 |
| 116 | 183 | 146 | 176 | 176 | 227.5 |
| 117 | 180 | 147 | 177 | 177 | 227 |
| 118 | 177 | 148 | 178.5 | 178 | 227 |
| 119 | 174 | 149 | 180 | 179 | 227.5 |
| 120 | 173 | 150 | 181 | 180 | 228 |
| 121 | 171 | 151 | 184 | 181 | 228.5 |
| 122 | 169 | 152 | 186 | 182 | 227.5 |
| 183 | 227 | 213 | 197 | 243 | 223.5 |
| 184 | 226.5 | 214 | 199 | 244 | 222.5 |
| 185 | 226 | 215 | 202 | 245 | 221 |
| 186 | 225 | 216 | 205 | 246 | 219 |
| 187 | 223 | 217 | 207 | 247 | 217.5 |
| 188 | 221 | 218 | 210 | 248 | 216 |
| 189 | 218 | 219 | 213 | 249 | 215.5 |
| 190 | 214 | 220 | 217 | 250 | 215 |
| 191 | 209.5 | 221 | 220 | 251 | 215 |
| 192 | 205.5 | 222 | 222 | 252 | 214.5 |
| 193 | 202 | 223 | 224 | 253 | 215 |
| 194 | 199 | 224 | 226 | 254 | 215 |
| 195 | 197 | 225 | 228 | 255 | 215.5 |
| 196 | 195 | 226 | 229 | 256 | 216.5 |
| 197 | 193 | 227 | 230 | 257 | 217 |
| 198 | 192 | 228 | 231 | 258 | 219 |
| 199 | 190.5 | 229 | 231.5 | 259 | 220 |
| 200 | 189.5 | 230 | 233 | 260 | 222 |
| 201 | 189 | 231 | 233 | 261 | 225 |
| 202 | 188.5 | 232 | 234 | 262 | 228.5 |
| 203 | 188 | 233 | 233 | 263 | 232.5 |
| 204 | 188.5 | 234 | 232.5 | 264 | 235 |
| 205 | 188.5 | 235 | 232 | 265 | 236 |
| 206 | 189.5 | 236 | 232 | 266 | 238.5 |
| 207 | 190 | 237 | 231 | 267 | 240 |
| 208 | 190.5 | 238 | 230 | 268 | 241 |
| 209 | 191.5 | 239. | 229 | 269 | 242 |
| 210 | 192 | 240 | 228 | 270 | 243 |
| 211 | 194 | 241 | 226 | 271 | 244 |
| 212 | 196 | 242 | 225 | 272 | 244.5 |
| 273 | 245 | 303 | 208 | 333 | 177 |

-continued

| DE-GREES | DIS-TANCE (mm) | DE-GREES | DISTANCE (mm) | DEGREES | DISTANCE (mm) |
|---|---|---|---|---|---|
| 274 | 245 | 304 | 205 | 334 | 178 |
| 275 | 245 | 305 | 205 | 335 | 179 |
| 276 | 245 | 306 | 203 | 336 | 180 |
| 277 | 244 | 307 | 202 | 337 | 182 |
| 278 | 243.5 | 308 | 200 | 338 | 182.5 |
| 279 | 243 | 309 | 198 | 339 | 184 |
| 280 | 243 | 310 | 196 | 340 | 185.5 |
| 281 | 242 | 311 | 194 | 341 | 187 |
| 282 | 242 | 312 | 192 | 342 | 189 |
| 283 | 241.5 | 313 | 189.5 | 343 | 190.5 |
| 284 | 240 | 314 | 187.5 | 344 | 192.5 |
| 285 | 239 | 315 | 186 | 345 | 195 |
| 286 | 238 | 316 | 183 | 346 | 197 |
| 287 | 236.5 | 317 | 181 | 347 | 198.5 |
| 288 | 235 | 318 | 179 | 348 | 200.5 |
| 289 | 234 | 319 | 177 | 349 | 203.5 |
| 290 | 232 | 320 | 175 | 350 | 205 |
| 291 | 230 | 321 | 173 | 351 | 208.5 |
| 292 | 228 | 322 | 171 | 352 | 211 |
| 293 | 226 | 323 | 170 | 353 | 213 |
| 294 | 225 | 324 | 170 | 354 | 217 |
| 295 | 223.5 | 325 | 171 | 355 | 220 |
| 296 | 222 | 326 | 171.5 | 356 | 224 |
| 297 | 219 | 327 | 172 | 357 | 227 |
| 298 | 218 | 328 | 172.5 | 358 | 230 |
| 299 | 216.5 | 329 | 173.5 | 359 | 234 |
| 300 | 214 | 330 | 174 | | |
| 301 | 212 | 331 | 175 | | |
| 302 | 210 | 332 | 176. | | |

3. Universal health seat according to claim 1, wherein said recess has a continuous concave surface, a transition of said recess with said top face is a circle having a circumferential edge with a radius of approx. 100 mm, and said recess can be described by circular arc segments extending downwards from said circle edge, which circular arc segments, if continued, converge in an imaginary deepest point of said recess situated on said axis, which deepest point lies approx. 13 mm lower than said top face, while a radius R of each circular arc segment is a function of said angle α and substantially corresponds to the following values:

| α (degrees) | RADIUS R (mm) |
|---|---|
| 45 | 1088.02 |
| 90 | 13828.15 |
| 135 | 567.96 |
| 180 | 385.38 |
| 225 | 745.88 |
| 270 | 13828.15 |
| 315 | 567.96 |
| 360 | 2015.29. |

4. Universal health seat according to claim 3, wherein a spherical protuberance is provided at the position of said imaginary deepest point of the recess.

* * * * *